United States Patent [19]

Keller

[11] Patent Number: 4,970,803

[45] Date of Patent: Nov. 20, 1990

[54] METHOD FOR DRYING SLUDGE

[75] Inventor: Karl Keller, Gutenzell, Fed. Rep. of Germany

[73] Assignee: Sulzer-Escher Wyss GmbH, Ravensburg, Fed. Rep. of Germany

[21] Appl. No.: 459,480

[22] Filed: Jan. 2, 1990

[30] Foreign Application Priority Data

Jan. 27, 1989 [DE] Fed. Rep. of Germany ..... 3902446

[51] Int. Cl.[5] ..... F26B 3/08

[52] U.S. Cl. ..... 34/10; 110/224; 34/17

[58] Field of Search ..... 34/10, 57 A, 57 B; 110/224, 245, 227

[56] References Cited

U.S. PATENT DOCUMENTS

| | | | |
|---|---|---|---|
| 4,159,682 | 7/1979 | Fitch et al. | 110/245 |
| 4,429,643 | 2/1984 | Mulholland | 110/224 |
| 4,583,470 | 4/1986 | Hirose | 110/224 |
| 4,628,833 | 12/1986 | O'Hagan et al. | 110/224 |
| 4,787,323 | 11/1988 | Beer et al. | 110/227 |

*Primary Examiner*—Henry A. Bennet
*Assistant Examiner*—Denise L. Ferensic
*Attorney, Agent, or Firm*—Werner W. Kleeman

[57] ABSTRACT

A sand layer is fluidized by a gas stream or current in a fluidized bed dryer and indirectly heated by immersed stationary heat-exchanger tubes. The sludge to be dried is continuously fed under pressure in a pumpable condition from above onto the fluidized sand layer. The sludge is coagulated in the fluidized sand layer to form sludge lumps. Here, the sludge lumps are successively dried from the surface down to the core thereof, and the already dried layers of the sludge lumps are successively abraded by the fluidized sand, whereby the sludge lumps are entirely comminuted and the dry matter thereof is pulverized to form dust. This product dust is continuously discharged together with the exhaust-gas stream from the fluidized bed dryer and continuously separated as a product from the exhaust-gas stream. The gas stream or current freed from dust is partially recycled in a closed circuit back to the fluidized bed dryer for fluidization of the sand layer.

9 Claims, 1 Drawing Sheet

1
2
3
4
5
6
7
8
9
10
11
12
13
14
15
16
17
18
19
20
21
22
23
24
25
26
27
28
29
30
31
32
33
34
35
36
37
38

METHOD FOR DRYING SLUDGE

BACKGROUND OF THE INVENTION

The present invention broadly relates to the treatment of aqueous materials and, more specifically, pertains to a new and improved method for drying sludge.

Generally speaking, in the practice of the invention for drying a sludge containing organic substances and obtained subsequent to the dewatering of a suspension, there is utilized a fluidized bed dryer having a heated sand layer which is fluidized by means of a gas stream or current for gaining as a product the dry matter of the sludge.

For such drying operations there can be provided all suspension, sludges, pastes and filter cakes from an almost endless variety of dewatering machines and installations. Such materials to be dried also include sewage sludges from municipal or industrial waste water or sewage, such sewage sludges originating from sewage treatment or clarification plants charged with such waste water or sewage.

These sludges are mechanically dewatered. Further processing, utilization or disposal thereof presupposes a thermal drying operation. The pasty sludges contain 40% to 60% water depending on the degree of dewatering, and such water content substantially impairs the handling or transport of sludge and the methods for utilization or disposal of the sludges. Thermal drying improves or augments the possibilities of utilizing or applying these sludges and/or reduces the resulting amount of sludge to be disposed of.

According to a method known to the art there is utilized a direct rotary or drum dryer. The sludge is fed, sometimes subsequent to pretreatment depending on the consistency, into a rotating drum inclined towards the outlet thereof and the sludge travels to the discharge or outlet end by continuous rolling motion within the rotating drum. At the same time, hot air or hot flue or exhaust gas streams through the rotating drum in co-current flow or contra-current flow and thereby absorbs the moisture of the sludge. This known installation or plant requires a relatively high constructional expenditure for its mechanical or machine components and employs a relatively energy-consuming drying operation, the humid and contaminated exhaust air from the rotary or drum dryer requiring complicated and uneconomical cleaning or purification for appropriate limitation of its emission.

Other drying apparatus known to the art are direct sand fluidized bed dryers. Hot air or hot flue or exhaust gases stream through a sand layer from the bottom toward the top, thus causing a fluidization of the sand filling or charge. An inflow floor or bottom provides for a uniform distribution of the inflowing hot gases. Several pumps force the sludge by means of jets or nozzles directly into the fluidized sand layer. The jets or nozzles are arranged just above the inflow floor or bottom, i.e. arranged within the lower quarter of the sand layer. The sludge dissipates or transfers its moisture to the through flowing hot gas which has to be cleaned or purified after discharge from the fluidized bed dryer.

Furthermore, there are known indirect contact dryers in which the heating of the sludge is indirectly effected by means of heating surfaces. Depending on the type of dryer, these heating surfaces possess the form of discs, paddles, rolls and the like. The steam-heated or oil-heated heating surfaces heat the sludge until the moisture thereof finally evaporates, a ventilator or blower sucking away the resulting exhaust vapors and compressing the latter to condensate. The sludges are either applied to the heating surfaces in a thin layer and then abrased or scraped off, or the heating surfaces are moved or stirred in the product to be dried.

A further drying apparatus known to the art from U.S. Pat. No. 4,330,411, granted May 18, 1982, is the indirect fluidized bed dryer which is also utilized to perform the method for drying sludge of the present invention. According to this known sludge-drying method utilizing an indirect fluidized bed dryer, a sludge granulate in a fluidized bed undergoes throughflow of superheated exhaust vapors in circulation from the bottom toward the top and is thereby fluidized. By virtue of an inflow floor or bottom provided with jets or nozzles, the gas is uniformly distributed across the entire surface of the fluidized bed dryer, thus ensuring a uniform fluidization of the sludge granulate. In this fluidized layer there are provided heating surfaces, for instance heat exchangers, which indirectly transfer the required drying energy to the sludge granulate. Such heating surfaces possess different forms, such as bare or flat tubes, finned or externally ribbed tubes, plates and the like, which are heated by means of steam or any other suitable heat-carrier. A granulator or granulating machine produces a moist stable granulate by mixing dewatered sludge and a portion of already dried sludge granulate. This moist stable granulate is fed into the fluidized layer where the granulate moisture is absorbed by the throughflowing superheated exhaust vapors. The dried granulate leaves the fluidized bed dryer via an overflow or separating weir or through a discharging apparatus. A portion of this dried granulate returns as add-back material to the granulator or granulating machine where dewatered sludge is added to prepare or yield the moist stable granulate. The exhaust vapors leaving the fluidized bed dryer also entrain fine-grained product particles and dust which are precipitated or separated in a cyclone or filter and discharged to the granulator or granulating machine. The amount or quantity of water evaporated during the drying process is withdrawn from the recycling system in the form of exhaust vapors and condensed or thermally heated.

With the heretofore employed drying methods utilizing direct rotary or drum dryers, direct sand fluidized bed dryers or indirect contact dryers it has been possible to achieve the expected advantages and results of the drying operation only by means of a relatively complicated mechanical-thermal process, such that the economic viability of the overall operation of drying sludge has been only partially taken into consideration.

SUMMARY OF THE INVENTION

Therefore, with the foregoing in mind, it is a primary object of the present invention to provide a new and improved method for drying sludge which does not suffer from the aforementioned drawbacks and shortcomings of prior art methods and processes for treating and/or drying sludge.

Another and more specific object of the present invention aims at providing a new and improved method for drying sludge in a manner such that a pretreatment of the sludge prior to the drying process can be dispensed with, that the discharge of dried matter from the dryer is essentially facilitated, and that the energy expenditure or consumption is substantially reduced.

Yet a further significant object of the present invention is concerned with a new and improved method for drying sludge in an efficient manner through the employment of the simplest possible means and equipment, thus reducing constructional expenditure.

Another important object of the present invention aims at providing a new and improved method for drying sludge which ensures continuous operation and permits using processing apparatus which is economical to manufacture and yet affords highly reliable operation without being subject to breakdown and malfunction, and also require a minimum of maintenance and space.

Still a further significant object of the present invention aims at providing a new and improved method for drying sludge by means of which the final product possesses a high dry-matter content to render possible easy product handling and transport, and by means of which an environmental load or contamination is substantially precluded.

Now in order to implement these and still further objects of the present invention which will become more readily apparent as the description proceeds, the method aspects of the present development contemplate, among other things, undertaking indirect heating of the sand layer by means of stationary heat-exchanger bodies immersed in the sand layer. The sludge is continuously conveyed in pumpable condition under pressure to the fluidized bed dryer and fed from above onto the fluidized sand layer in counter-current flow to the fluidizing gas stream or current, thus coagulating the sludge into sludge lumps in the heated fluidized sand layer. These sludge lumps in the fluidized sand layer are successively dried by transferring moisture thereof to the fluidizing gas stream or current and by successively abrading the already dried-up layers of the sludge lumps by the fluidized sand of the fluidized sand layer, thus pulverizing the dry matter of the sludge. The pulverized dry matter from the fluidized sand layer, together with the exhaust-gas stream, is continuously discharged from the fluidized bed dryer. Thereafter, pulverized dry matter is continuously separated as a product from the exhaust-gas stream.

The heating of the sand layer can be advantageously effected by means of bare heat-exchanger tubes which are substantially horizontally arranged in the fluidized bed dryer, such heat-exchanger tubes being constructed for throughflow passage of a suitable heat-carrier medium.

As a suitable heat-carrier medium there are advantageously used flue gases from a combustion chamber in which fossil fuel is burned. After the flue gases have streamed through the heat-exchanger tubes, at least a portion of these flue gases is returned to the combustion chamber to recover residual heat and then recycled.

Subsequent to the separation of the pulverized dry matter, the exhaust-gas stream is advantageously recycled to fluidize the sand layer, whereby the volume of the exhaust gases is reduced by the superfluous gas volume produced during the drying process in the fluidized bed dryer to the volume to be applied for the fluidization process in the fluidized bed dryer.

Such reduction of the exhaust-gas volume is effected by condensation of the condensable constituents or components in the exhaust gas, particularly of the volume of the water vapor additionally formed during the drying process. The noncondensable gas components remain in circulation, so that there results a chemically nonreactive gas mixture of water vapor and the other gas components which are released during the drying process, thus advantageously precluding an oxidation of the sludge during the drying process.

The dry-matter dust, which after separation from the exhaust gas can comprise approximately 70% dry matter by weight, is beneficially processed by admixing a part of the supplied or available sludge to form a mixture of desired moisture, such mixture being processed to produce a granulate. The sludge to be dried according to the inventive method can be a sewage sludge from municipal or industrial sewage water.

BRIEF DESCRIPTION OF THE DRAWING

The invention will be better understood and objects other than those set forth above will become apparent when consideration is given to the following detailed description thereof. Such description makes reference to the annexed drawing which shows, diagrammatically, a flow chart of a plant constructed for performing the inventive method for drying a dewatered sewage sludge from a municipal sewage treatment plant.

DETAILED DESCRIPTION OF THE PREFERRED EMBODIMENTS

Figure 1:
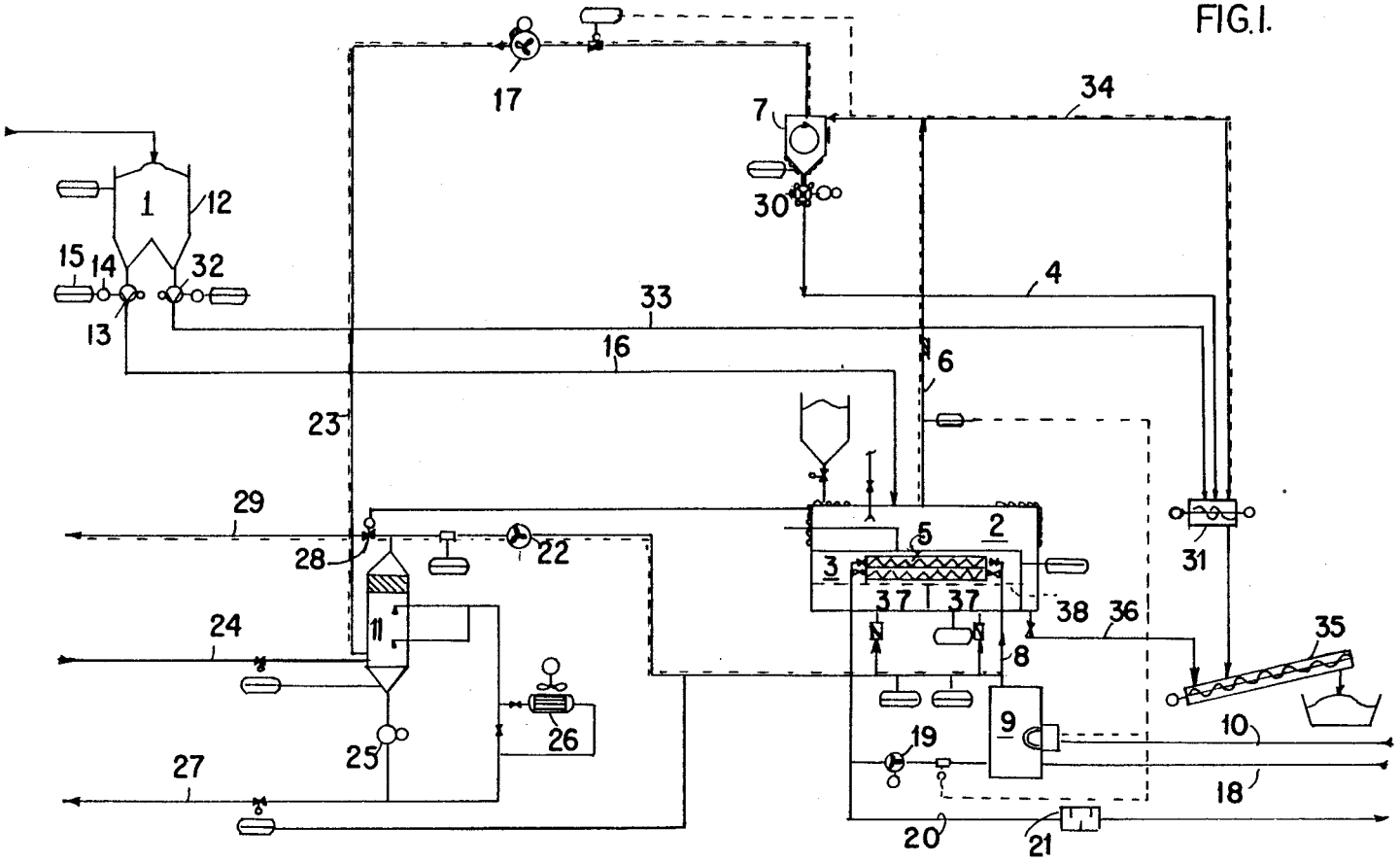

Describing now the drawing, it is to be understood that to simplify the showing thereof, only enough of the structure of the plant for drying sludge, typically a sewage sludge, has been illustrated therein as is needed to enable one skilled in the art to readily understand the underlying principles and concepts of this invention.

Turning attention now to an exemplary embodiment of a plant for drying sludge, as schematically depicted in the drawing, and suitable for the performance of the inventive method, there is shown a sludge 1 which, subsequent to a dewatering process, is a suspension containing organic substances. Such suspension with a water content of still approximately 40% is in a pumpable condition and kept in stock in a silo or reservoir 12. By means of a pump 13, whose driving motor or drive means 14 is speed-variable by means of a control device or unit 15, the sludge 1 is pumped via a supply line or conduit 16 into a fluidized bed dryer 2 in which, during operation, there is built up a heated sand layer 3 which is fluidized by means of a gas stream or current.

The sand layer 3 fluidized by the gas stream or current is indirectly heated by means of stationary heat-exchanger bodies 5 immersed in the fluidized sand layer 3. The pumpable sludge 1 to be dried is fed under pressure from the pump 13 into the fluidized bed dryer 2 and from above onto the fluidized sand layer 3 in counterflow to the fluidizing gas stream or current. The sludge infeed locations are provided at the uppermost region of the fluidized bed dryer 2. The fluidized sand of the sand layer 3 entrains the sludge 1 immediately after departure thereof from nozzles or mouthpieces or the like of a suitable distributing device not particularly shown in the drawing. The sludge 1 to be dried coagulates during this operation and there are formed sludge lumps which, due to fluidization, spread within the fluidized sand layer 3 and move in floating or suspended manner within the latter. The hot sand and the hot fluidizing gas successively radiate thermal energy to the moist or humid sludge lumps, this leading, under evaporation of water, to a substantially continuous or steady heating of the sludge lumps, in that successively layer by layer is heated from the surface down to the core of the individual sludge lumps. The water vapor is absorbed by the gas stream or current and carried out of the fluidized bed dryer 2 together with exhaust gas 6a. At the same time, the fluidized sand continuously abrades the already dried layer of the individual sludge lumps and grinds the dry sludge, i.e. the dry matter thereof, down to fine dust. This process of pulverizing sludge is accomplished at each sludge lump up to total drying and abrasion down to the core thereof, i.e. until the remaining sludge dry matter is successively and totally abraded and thus pulverized. The rising fluidized gas stream or current entrains not only the water vapor, but also the pulverized sludge dry matter, i.e. the product dust 4a. In this manner, the gas stream or current continuously discharges the product 4a with the exhaust-gas stream 6a out of the fluidized bed dryer 2 through line or conduit 6 in dependence upon the speed of the gas stream or current.

The pulverized dry matter or product 4a, in other words the sludge dry matter, is continuously separated as product from the exhaust-gas stream 6a in a separating stage, namely in a cyclone or cyclone separator 7. A ventilator or blower 17, arranged downstream of the cyclone or cyclone separator 7 as viewed in the direction of material or gas flow, removes by suction the exhaust-gas stream and therewith prevents a pressure rise due to water evaporation or other formation of gas during the drying operation in the fluidized bed dryer 2.

The heating of sand in the fluidized sand layer 3 and of the fluidizing gas stream or current is effected by means of the stationary heat-exchanger bodies 5 through which flows a heat-carrier medium. These heat-exchanger bodies 5, preferably bare heat-exchanger tubes, are substantially horizontally arranged in the predetermined region of the sand layer 3 in the fluidized condition thereof in the fluidized bed dryer 2. The heat-carrier medium is here constituted, for instance, by flue gases 8a flowing through line or conduit 8 and which are generated or produced in a combustion chamber 9 by burning fossil fuel infed via line or conduit 10. The required combustion air is guided through a supply line or conduit 18. After flowing or streaming through the bare heat-exchanger tubes 5, at least a portion of the flue gases 8a is removed by suction by means of a ventilator or blower 19 and guided into the combustion chamber 9 to recover the residual heat of the aforesaid portion of the flue gases 8a and to be thus recycled. The superfluous part of these flue gases 8a is taken out of circulation via a withdrawing line or conduit 20 and discharged through a sound absorber or damper 21.

The exhaust-gas stream 6a, from which the product 4a has been separated, is continuously recycled to fluidize the sand layer 3 of the fluidized bed dryer 2. Subsequent to the separating process in the cyclone or cyclone separator 7, the exhaust gas 6a still contains the entire water vapor newly formed in the fluidized bed dryer 2 and the other gases formed or generated there. This additional volume of gas must be withdrawn or removed from the gas recycling system in order to maintain substantially constant the pressure in such gas recycling system. The gas volume reduced to the amount or quantity of gas actually required for the fluidization of the sand layer 3 in the fluidized bed dryer 2 is guided via a ventilator or blower 22, gas distributors 37 and an inflow floor or bottom 38 of the fluidized bed dryer 2, so that the gas circulation constitutes a closed loop.

The reduction of the superfluous quantity of gas is here effected, for instance, by condensing the condensable excess or surplus gas, particularly the superfluous water vapor in a condenser 11, into which the entire exhaust gas stream leaving the cyclone 7 is guided via a line or conduit 23. The condensing process is effected in the condenser 11 by spraying or sprinkling the exhaust gas with cooling water for which a line or conduit 24 is provided. The water with the condensate is recirculated by means of a pump 25 and, if provided, via a suitable cooler 26, whereby an excess or surplus is removed via a withdrawing line or conduit 27. Should an excess gas volume still exist in the recycling system subsequent to the condensing process in the condenser 11, a corresponding amount or quantity of exhaust gas can be discharged from the recycling system by opening a suitable valve 28 arranged in the withdrawing line or conduit 29. Water vapor and the gases formed during the drying process remain in the cycle or circuit. Accordingly, in this recycling system the gas cycle or circuit used for fluidization comprises a continuously decreasing free oxygen content, so that finally the process in the fluidized bed dryer 2 and downstream of the latter, as viewed in the direction of material or gas flow, is effected in a nonreactive atmosphere, such that a combustion or explosion hazard is advantageously eliminated.

The product dust in the cyclone or cyclone separator 7 comprises approximately 90% dry matter. The pulverized sludge dry matter obtained from a discharge apparatus 30 is guided to a mixer 31 where a portion of the sludge 1 from the silo or reservoir 12 is added to the product dust by means of a speed-controllable pump 32 via a supply line or conduit 33, such that a desired final moisture content of the product is set. From this mixer 31 to the cyclone or cyclone separator 7 there is provided a line or circuit 34 through which the gases formed or generated in the mixer 31 are withdrawn. The mixer 31 is provided with a suitable granulator or granulating machine in which the product containing the desired final moisture content is processed to form a granulate. The final product processed in such a manner is then prepared for loading or shipping by means of a suitable transport device 35 to which a withdrawing line or conduit 36 is connected and which, if necessary, serves for emptying the fluidized bed dryer 2.

In the flow chart schematically illustrated in the drawing there are shown, in compliance with standards or prevailing practise, at several locations different devices for measuring and controlling pressure and temperature, such devices being utilized for monitoring and controlling the processing steps of the inventive method. These devices are considered to be known and conventional and therefore do not have to be further described. With the aid of such control equipment it is rendered possible to at least substantially automate the operation of the plant for drying sludge.

The inventive method is suitable for drying different suspensions, sludges, pastes and filter cakes from a large variety of dewatering apparatus and plants. The foregoing description refers in the main to the method for drying municipal and/or industrial sewage sludges.

Having now had the benefit of the foregoing discussion of the plant constructed for the performance of the inventive method of drying sludge, the advantages of such a plant are hereinafter listed and are as follows:

The sludges no longer have to be structurally formed or granulated prior to being fed into the fluidized bed dryer 2. Since the fluidized sand pulverizes the dried sludges to dust and the dust is discharged with the exhaust-gas stream 6*a*, no complicated discharge mechanism is required for the fluidized bed dryer 2. A recycling of the product 4*a* as add-back material for granulation can also be dispensed with.

The fluidized bed dryer 2 operates in a substantially chemically nonreactive atmosphere which consists of slightly superheated exhaust vapors and of the gases which are contained in the sludges, such atmosphere containing no free oxygen.

The fluidized sand in the fluidized bed dryer 2 is a totally inert material in the drying process, such material not chemically reacting with the sludge 1, the moisture or the circulating or recycling gas. In such manner, combustion or explosion by excess heating in the fluidized bed dryer 2 is precluded.

The thermal energy for drying the material is indirectly transferred to the material or to the fluidized sand. In such manner, the heating medium does not come into direct contact with the material or with the fluidized sand. By virtue of such indirect heating, the evaporated moisture is obtained in the form of water vapor and as such can be removed by simple condensation by utilizing lost or waste heat.

At the substantially horizontal bare-tube heat exchangers 5 located in the fluidized sand layer 3 there is effected an extremely intensive energy exchange with a high specific heating or thermal efficiency. An optimum grain distribution of the sand, which is selected according to the material to be dried, renders possible a relatively low gas speed and a higher thermal efficiency than in a fluidized bed dryer with a product-granulate layer. The electric energy requirement for driving the ventilators or blowers is thus substantially reduced.

The fluidized sand layer 3 continuously cleans the immersed heating surfaces during operation, so that a possible loss of efficiency because of dirt or contamination is precluded.

The substantially horizontal bare-tube heating surfaces are stationary and, therefore, constitute static heat exchangers. The bare-tube heat exchangers 5 are not only heatable by steam or liquid heat-carriers, but render possible efficient heating by means of hot gases such as air or flue or smoke gases. The hot flue gases can be provided in the form of lost or waste heat or are obtained from a combustion chamber with direct fuel combustion. Instead of the conventional two heat transfers in hitherto indirectly heated fluidized bed dryers, namely the transfer from the flue gas to the heat-carrier medium and the transfer from the heat-carrier medium to the product, there is here required only one heat transfer from the flue gas to the product.

By virtue of the inert sand layer 3, the fluidized bed dryer 2 remains absolutely insensitive in the event of temperature fluctuations or excess heating. The sand layer also permits rapid heat-up and renders possible start-up of the plant immediately with rated or normal power. Also in the case of shutdown of the plant, an inevitable coasting of temperature is absolutely harmless for the inert sand filling.

According to a further application or utilization of the product of the drying process, the powdery dust product can be processed to possess a desired moisture content, in that dry matter concentration is in the range between 50% and 90% dry matter by weight.

While there are shown and described present preferred embodiments of the invention, it is to be distinctly understood that the invention is not limited thereto, but may be otherwise variously embodied and practiced within the scope of the following claims.

Accordingly, what I claim is:

1. A method of drying a sludge containing organic substances and obtained subsequent to the dewatering of a suspension, comprising the steps of:
   - providing a fluidized bed dryer having a sand layer which is fluidizable by means of a gas stream;
   - indirectly heating the sand layer by means of stationary heat-exchanger bodies which are immersed in the sand layer;
   - continuously feeding under pressure the sludge in pumpable condition into the fluidized bed dryer and from above onto the sand layer in counter-current flow to the fluidizing gas stream;
   - coagulating the sludge to form sludge lumps in the heated fluidized sand layer;
   - successively drying the sludge lumps in the sand layer;
   - said step of successively drying the sludge lumps comprising transferring moisture from the sludge lumps to the fluidizing gas stream and successively abrading already dried layers of the sludge lumps by the fluidized sand of the sand layer, so that dry matter of the sludge is pulverized;
   - continuously discharging the pulverized dry matter from the sand layer together with an exhaust-gas stream out of the fluidized bed dryer; and
   - after departure of the pulverized dry matter with the exhaust-gas stream from the fluidized bed dryer, continuously separating the pulverized dry matter as a product from the exhaust-gas stream.

2. The method as defined in claim 1, wherein:
   - said step of indirectly heating the sand layer entails the step of utilizing bare heat-exchanger tubes which are substantially horizontally arranged in the fluidized bed dryer and further entails the step of passing a heat-carrier medium through such bare heat-exchanger tubes.

3. The method as defined in claim 2, wherein :
   - said step of passing a heat-carrier medium through the bare heat-exchanger tubes entails utilizing flue gases from a combustion chamber in which fossil fuel is burned.

4. The method as defined in claim 3, further including the steps of:
   - after departure of the flue gases from the bare heat-exchanger tubes, returning at least a portion of the flue gases to the combustion chamber; and
   - recovering residual heat from said portion of the flue gases and recycling the latter.

5. The method as defined in claim 1, further including the steps of:
   - subsequent to said step of continuously separating the pulverized matter as a product from the exhaust-gas stream, reducing the volume of the exhaust gases by a superfluous gas volume produced during the drying step in the fluidized bed dryer to a gas volume to be applied for the fluidization process in the fluidized bed dryer; and
   - recycling said gas volume to be applied for the fluidization process in the fluidized bed dryer.

6. The method as defined in claim 5, wherein:
   - said step of reducing the exhaust gas volume entails the step of condensing condensable components in the exhaust gas and, particularly, water vapor additionally formed during the drying step, and further entails the step of recycling noncondensable components of the exhaust gas, so that there results a chemically nonreactive gas mixture of water vapor and other gas components released during the drying step, thus precluding oxidation of the sludge during the drying step.

7. The method as defined in claim 1, including the step of:

subsequent to said step of continuously separating the pulverized dry matter as a product of the exhaust gas stream, which product can contain approximately 70% dry matter by weight, admixing a part of the provided sludge to the pulverized dry matter to prepare a mixture having a desired moisture content.

8. The method as defined in claim 7, including the step of:

processing the mixture having a desired moisture content to form a granulate.

9. The method as defined in claim 1, including the step of:

feeding sewage sludge from municipal and industrial sewage water to the fluidized bed dryer.

* * * * *